US006693602B1

(12) United States Patent
Dey et al.

(10) Patent No.: US 6,693,602 B1
(45) Date of Patent: Feb. 17, 2004

(54) ANTENNA SYSTEM

(75) Inventors: Holger Dey, Ober-Moerlen (DE); Gerhard Haneberg, Senden (DE); Friedemann Kombrink, Langenau (DE); Harry Mähr, Laupheim (DE)

(73) Assignee: EADS Radio Communication Systems GmbH & Co. KG, Ulm (DE)

( * ) Notice: Subject to any disclaimer, the term of this patent is extended or adjusted under 35 U.S.C. 154(b) by 0 days.

(21) Appl. No.: 10/130,352

(22) PCT Filed: Nov. 17, 2000

(86) PCT No.: PCT/DE00/04037

§ 371 (c)(1),
(2), (4) Date: Sep. 23, 2002

(87) PCT Pub. No.: WO01/39327

PCT Pub. Date: May 31, 2001

(30) Foreign Application Priority Data

Nov. 19, 1999 (DE) ..... 199 55 950

(51) Int. Cl.[7] ..... H01Q 9/16
(52) U.S. Cl. ..... 343/822; 343/715; 343/820
(58) Field of Search ..... 343/713, 715, 343/793, 795, 802, 820, 821, 822, 850, 859, 860; H01Q 9/16

(56) References Cited

U.S. PATENT DOCUMENTS 3,836,975 A * 9/1974 Cassel ..... 343/792.5
4,038,662 A * 7/1977 Turner ..... 343/752
4,201,990 A * 5/1980 Altmayer ..... 343/747
4,319,249 A * 3/1982 Evans et al. ..... 343/703
4,479,130 A * 10/1984 Snyder ..... 343/802
5,440,318 A * 8/1995 Butland et al. ..... 343/814
5,517,206 A 5/1996 Boone et al.
5,528,252 A 6/1996 Skahill

FOREIGN PATENT DOCUMENTS

| | | |
|---|---|---|
| DE | 120 977 | 7/1976 |
| EP | 0 428 229 | 5/1991 |
| EP | 0 809 321 | 11/1997 |
| GB | 2 316 233 | 2/1998 |

OTHER PUBLICATIONS

English Language Abstract of JP 9–130132.

* cited by examiner

*Primary Examiner*—Tho Phan
(74) *Attorney, Agent, or Firm*—Crowell & Moring LLP

(57) ABSTRACT

An antenna system (1) with a particularly simple Con and a steep transmission angle, for lower frequencies in the short wave range. The inventive antenna system includes two antennae (2) which are interconnected by a control unit (4) and which together form a dipole antenna. This antenna system (1) is particularly suitable for mobile operation in vehicles.

10 Claims, 4 Drawing Sheets

ANTENNA SYSTEM

BACKGROUND AND SUMMARY OF THE INVENTION

This application claims the priority of German Patent Document No. 199 55 950.3, filed Nov. 19, 1999, and PCT International Application No. PCT/DE00/04037, filed Nov. 17, 2000, the disclosures of which are expressly incorporated by reference herein.

The invention relates to an antenna system for transmitting and receiving electromagnetic waves, particularly in the short-wave range. Furthermore, the invention relates to a vehicle having such an antenna system which is suitable for a mobile use.

Normally, when antennas are used in a mountainous terrain or when electromagnetic waves are transmitted, particularly in the short-wave range, a radiation of the energy is required which is as vertical or steep as possible. So-called dipole antennas are known as the ideal antennas with a radiation angle which is as vertical as possible. An ideal radiation characteristic occurs particularly in the case of a dipole antenna (abbreviated "dipole") whose length corresponds to half the wavelength and which is generally called a lambda half dipole (also called $\lambda/2$ dipole). The transmission behavior and vice versa the reception behavior of a lambda half dipole is characterized by a largely good omnidirectional characteristic and a relatively large vertical radiation angle. In the case of the lambda half dipole, it is a disadvantage that, for a particularly broad-band use in the short-wave range, for example, of from 2 to 30 MHz, the antenna length fluctuates between 75 and 5 m. Thus, such an antenna system constructed of a lambda half dipole is not suitable for a mobile use. Furthermore, dipole antennas can be used in the lower frequency range only if they are correspondingly damped. This, in turn, is connected with considerable losses which are avoided by providing matching units. However, because of the high requirements with respect to quality and matching precision, these matching units result in very high expenditures. In addition, because of the doubling of impedance values for a short dipole in comparison to the impedance values of a simple rod antenna, matching is hardly possible, so that the use of a dipole antenna for a particularly wide frequency range in the short-wave range is possible only to a limited extent and may even be impossible.

Therefore, frame or loop antennas are normally used. A frame antenna is a so-called short-circuit antenna which, in comparison to the dipole antenna, has, for the most part, good frequency behavior within a wide frequency range, in which case the radiation characteristic is limited with respect to a steep radiation angle. Because of the very high currents of the frame antenna, which are unavoidable in the operation of the antenna system, this frame antenna comprises very high-expenditure motors and electrical components which are fixedly installed. An exchange of components or a fast mounting/demounted of the entire antenna system is therefore not possible or is possible only to a very limited extent.

In European Patent Document EP 0 809 321 A1, an antenna system is described which has two dipole halves which are connected by way of a control unit. The control unit comprises a power divider module, as well as a matching module for each dipole half, as well as a central control unit which is connected with each of the two matching modules and controls them.

It is therefore an object of the invention to indicate an antenna system for a largely broad frequency range, which antenna system has a particularly simple construction, and a radiation characteristic which is as vertical or steep as possible, and is suitable particularly for a mobile use.

This object is achieved according to the invention by means of an antenna system for frequencies particularly in the short-wave range. It comprises two antennas which are mutually connected by way of a control unit and jointly form a dipole antenna. In other words, the two antennas are electrically connected with one another by means of the control unit such that they form a dipole antenna with respect to the beam characteristic. As a result, while the particularly good steep-radiation characteristic of a dipole antenna is utilized, a simple construction of the antenna system is simultaneously permitted.

Expediently, a rod antenna which is constructed as a monopole is in each case provided as the antenna. By connecting two monopoles to form a dipole antenna, on the one hand, the good steep-radiation characteristic in the short-wave range, on which the dipole antenna is based, will be utilized. On the other hand, because of the low input impedance, the use of the rod or monopole antennas permits a largely simple matching of the impedance range, whereby a particularly simple construction of the control unit is ensured.

The control unit and the two antennas are preferably arranged on a carrier element. The carrier element is preferably provided for mounting on a vehicle. A frame or a roof rack, for example, can be used as the carrier element. As a result, the antenna system is particularly easy to mount or to demount. Without being changed, the antenna system can be mounted by means of the carrier element on various vehicles independently of the vehicle type and is therefore suitable for a universal use on mobile vehicles.

Advantageously, for the radiation of a certain frequency, the two antennas are connected with the control unit such that the two antennas can be excited or fed by signals which are phase-rotated by 180° with respect to one another. As a result of the connection of the two antennas to form a common dipole with such an antiphase relationship of the two signals, for the most part good frequency behavior is ensured while the radiation energy is simultaneously as large as possible.

In another advantageous further development of the antenna system, the control unit has a modular construction. The control unit expediently comprises at least one matching module and one power divider module. In this case, the matching module is used for matching the output of the control unit to the respective input impedance of the two antennas. By means of the power divider module, each antenna is fed symmetrically. For this purpose, a signal emitted by a transmitter is separated with a definable power by means of a power divider module; that is, half of each antenna is fed by means of the transmission power emitted by the transmitter. Such a modular construction of the control unit permits a particularly high degree of availability and independence of the antenna system. As an alternative, because of the modular construction of the antenna system, the latter can particularly easily be modified from a dipole arrangement to a simple monopole antenna. In this case, for example, one of the two antennas is deactivated by means of the control unit or is simple separated from the control unit.

In order for the antenna system can be used for a plurality of frequencies in the short-wave range, the matching module for a definable frequency comprises at least one L/C element (L element=coil, C element=capacitor). The matching module preferably includes a measuring unit and a control. By means of the measuring unit, the input impedance pertaining to the given frequency is determined. The control has the effect that, by means of the impedance values determined for the two antennas, correspondingly at least one L/C element and/or the number of so-called network elements required for the matching, such as L-elements, C-elements, is switched active. The tuning or matching operation preferably takes place iteratively for each antenna; that is, in an iterative process, the measured values determined by the measuring unit are supplied to the control for the determination of the number of L/C elements required for the matching. In each iteration cycle, the measured values and/or the number of the L/C elements are determined for both antennas, in which case the mutual dependence of the two antennas as a result of their electric coupling is taken into account. The connection of the L/C element or of the L/C elements preferably takes place synchronously for ensuring the antiphase excitation of the two antennas.

For a particularly rapid frequency change-over, the matching module expediently has a memory module in which, for various frequencies, the size and the number of L/C elements to be switched, that is, corresponding network settings, are filed. The filing preferably takes place after a concluded matching operation. For example, for a frequency range of from 2 to 30 MHz at intervals of 5 MHz, the respective pertaining impedance values and, resulting therefrom, the corresponding number, type, and/or size of the L/C elements are filed. Instead of an actual measuring of the input impedance, the corresponding combination and/or number of L/C elements will then automatically be activated by means of the control unit for a given frequency.

According to the invention, one matching module respectively is provided for each antenna. When the two antennas are identical, the respective pertaining matching module has the same construction, whereby the manufacturing costs are minimized. According to the invention, the two matching modules are connected with one another by way of a control cable. According to the invention, after an initialization phase, the two matching modules are connected with one another such that one matching module operates as a master and the other operates as a slave. In this case, the synchronization of the two matching modules takes place by way of the control cable such that the matching module operating as a master determines the required number and values of the L/C elements for the respective antenna. The matching module operating as a slave receives corresponding synchronized measuring and/or control commands from the master by means of the control cable.

For dividing the power of the radiation energy to be emitted to the two antennas, a transformer is preferably provided as the power divider module. The transformer has a particularly robust and simple construction and divides the signal coming from the transmitter with its total power into two signals with one half the power respectively and therefore with the same power.

The antenna system is preferably arranged on a vehicle, at least one device being provided which holds the two antennas predominantly in the horizontal position and diametrical with respect to one another. In other words, the free end areas of the respective antenna are arranged essentially horizontally, the two free end areas pointing away from one another at an angle of 180°.

In a further advantageous development, one matching module respectively is provided for each antenna. When the two antennas are identical, the respective pertaining matching module has the same construction, whereby the manufacturing costs are minimized. The two matching modules are expediently connected with one another by way of a control cable. After an initialization phase, the two matching modules are preferably connected with one another such that one matching module operates as a master and the other operates as a slave (sic-translator). In this case, the synchronization of the two matching modules takes place by way of the control cable such that the matching module operating as a master determines the required number and values of the L/C elements for the respective antenna. The matching module operating as a slave receives corresponding synchronized measuring and/or control commands from the master by means of the control cable.

As an alternative or in addition, the antenna system may include at least one antenna (2) which, in turn, itself is constructed as an antenna system with two antennas which are connected with one another by way of a control unit. As a result, an antenna system is provided which has a high quality and particularly good high-frequency characteristics.

The advantages achieved by means of the invention, in particular, consist of the fact that, as a result of the arrangement of two antennas each constructed as a monopole to form a dipole antenna, the particularly good beam features characterizing the dipole antenna are ensured while the construction of the antenna system is simultaneously simple. Furthermore, the largely simple matching of the two antennas permits a modular construction of the control unit, whereby a largely good flexibility and mobility of the entire antenna system as well as the exchangeability of individual components is ensured.

BRIEF DESCRIPTION OF THE DRAWINGS

Embodiments of the invention will be explained in detail by means of a drawing.

DETAILED DESCRIPTION OF THE PREFERRED EMBODIMENT

Mutually corresponding parts are provided with the same reference numbers in all figures.

Figure 1:
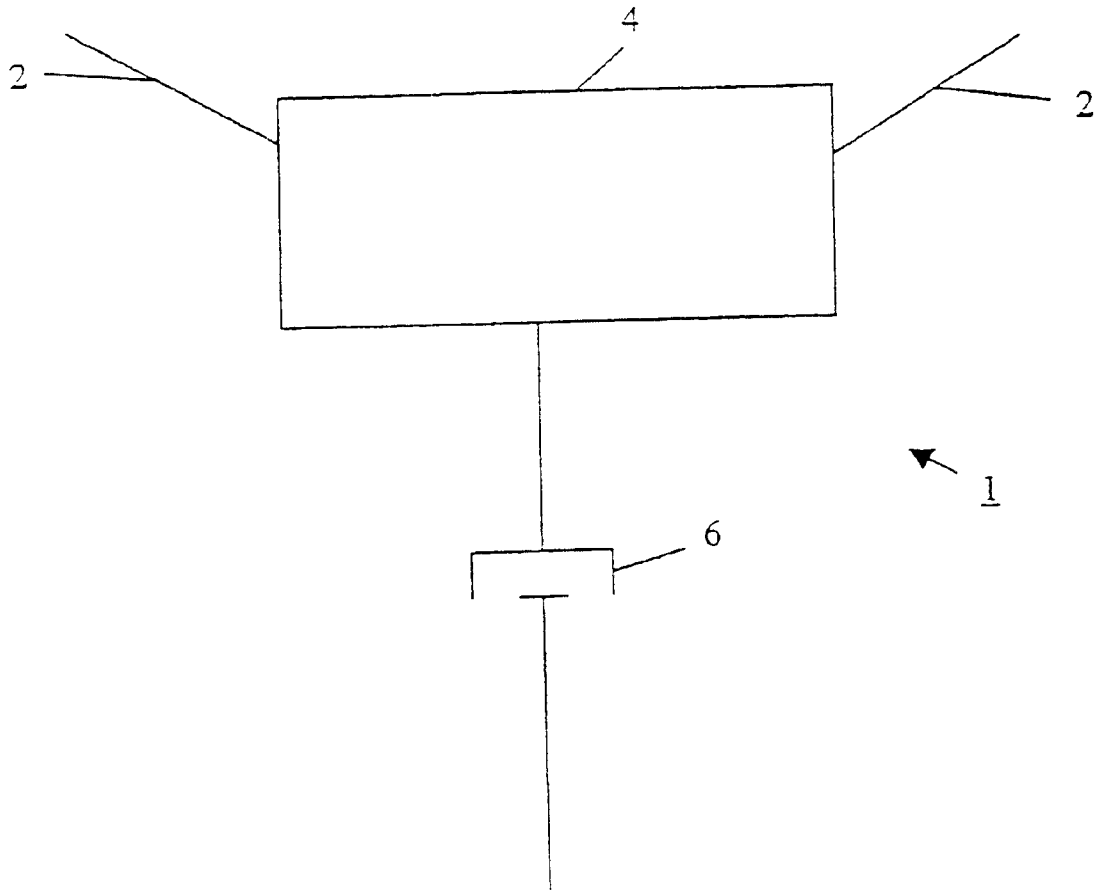
FIG. 1 is a view of an antenna system having two antennas connected by way of a control unit.

FIG. 1 illustrates an antenna system 1. The antenna system 1 comprises two antennas 2 which are connected with one another by way of a control unit 4. The two antennas 2 jointly form a dipole antenna. The two antennas 2 are electrically coupled with one another by way of the control unit 4. The two antennas 2 are each preferably constructed as a monopole. A monopole refers to an individual rod antenna. The two antennas 2 are connected with one another by means of the control unit such that they have the radiation characteristic of a dipole during the operation. As a result of such a connecting of two monopoles to form a dipole, a radiation angle of from 70° to 90° is permitted.

The antennas 2 are connected with the control unit 4 by way of contacts which are not shown in detail, for example, by way of simple plug-type or screwed connections. The control unit 4 is connected by means of a plug unit 6 with a transmission and/or reception unit not shown in detail. In this case, the plug unit 6 is constructed such that the control unit 4 can be mounted or demounted particularly easily. Thus, all components—the antennas 2 and the control unit 4—are connected with one another such that, as a result of the simple connections, they can arbitrarily be exchanged or supplemented by additional components.

By means of the control unit 4, the two antennas 2 are fed symmetrically; that is, the two antennas 2 are fed, with respect to the power, with half the radiation power respectively. The frequencies fed to each of the antennas are preferably phase-rotated by 180° with respect to one another. Because of the use of the antenna system 1 for various frequencies in the short-wave range, particularly in a range of from 2 to 30 MHz, the control unit 4 is, in addition, also used for the matching of the two antennas 2, particularly for the adaptation to the input impedance.

Figure 2:
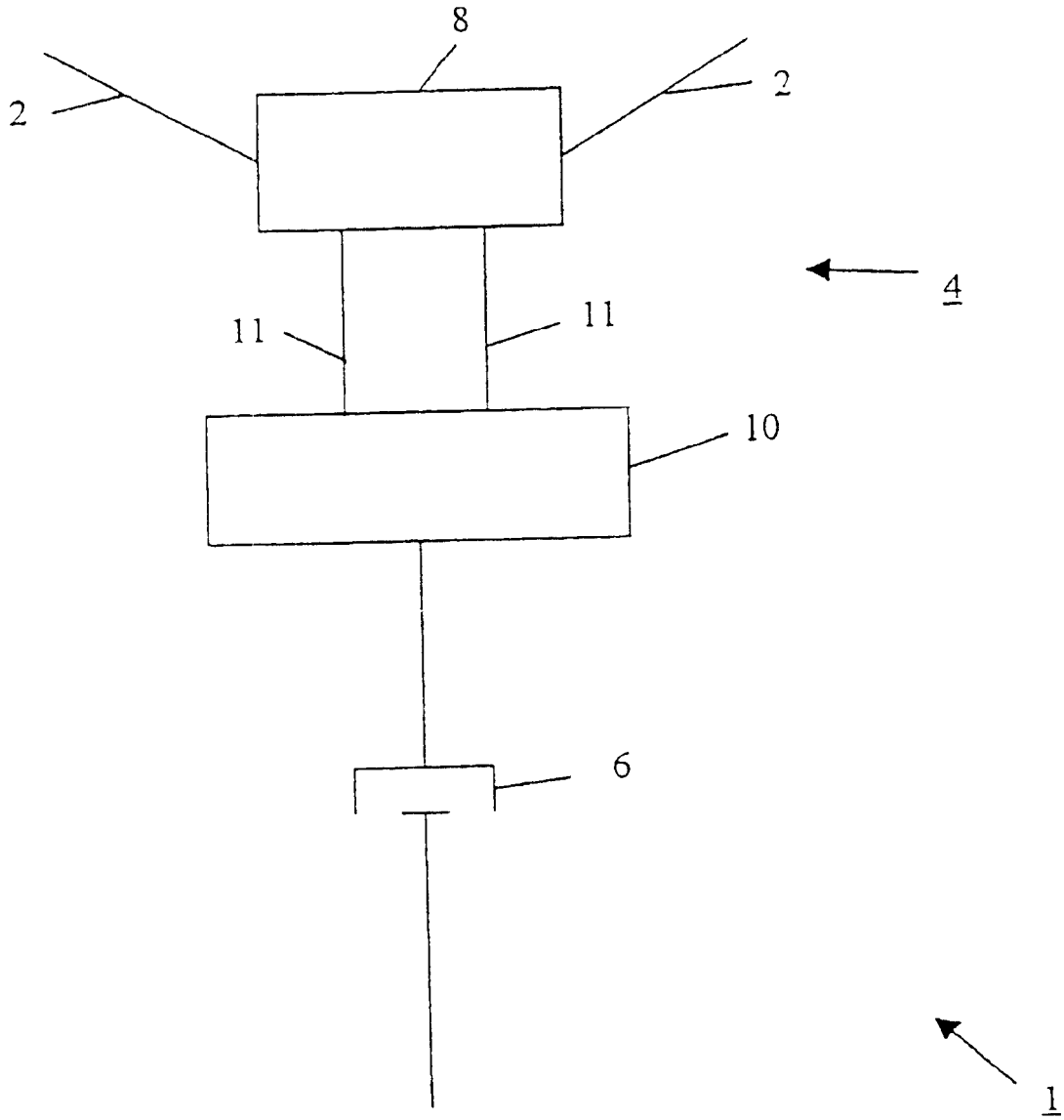
FIG. 2 is a view of an antenna system having a control unit which comprises a matching module and a power divider module.

FIG. 2 shows the antenna system 1 with an alternative control unit 4 which has a modular construction. In this case, the control unit 4 comprises a matching module 8 and a power divider module 10. The two modules—matching module 8 and power divider module 10—are connected with one another by way of two control lines 11. The power divider module 10 is used for dividing the transmission power supplied by an amplifier (not shown), half of which transmission power is fed to the respective antenna 2 by means of the control lines 11 by way of the matching module 8. For example, in the case of a power of the amplifier of 400 W, each antenna 2 is fed with 200 W. A transformer is preferably provided as the power divider module 10. The matching module 8 is used for the matching or tuning of the respective antenna 2. For this purpose, the matching module 8 has a number of L/C elements which are not shown in detail.

Figure 3:
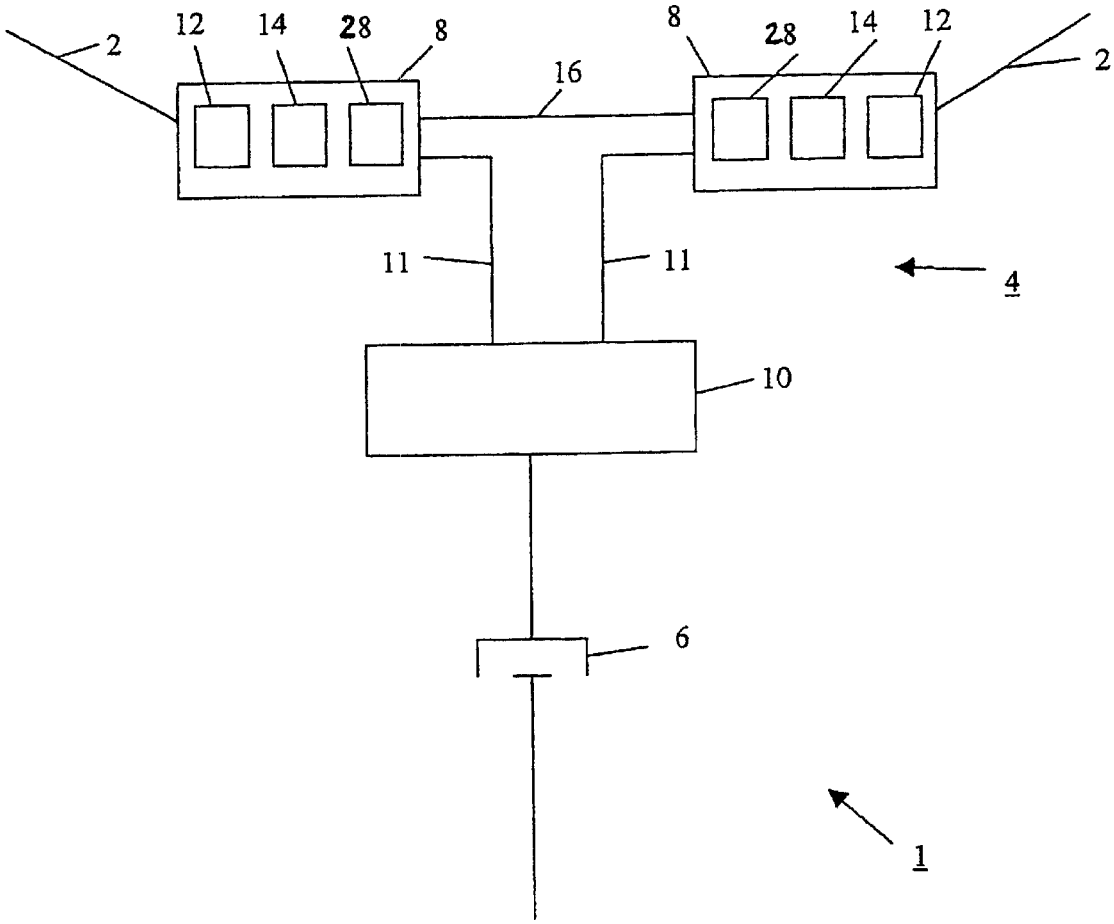
FIG. 3 is a view of an antenna system having a control unit which comprises two matching modules and a power divider module.

FIG. 3 shows another alternative embodiment of the control unit 4 with two matching modules and the power divider module 10. In this case, each matching module 8 is connected with a pertaining antenna 2. The two matching modules 8 are connected with one another by way of a control cable 16. Each of the matching modules 8 is 8 is connected wit the power divider module 10 by way of a pertaining control line 11.

For the matching of the input impedance, the respective matching module 8 has a measuring unit 12 for determining measuring values, particularly for the determination of input impedances, and a control 14, which is used for the activation of a number of L/C elements, particularly C-elements, required for the matching of the respective input impedance. The matching process takes place in an initialization process, in which one of the two matching modules 8 is defined as the master and the other is defined as the slave such that, in the master, by means of the determined measured values of the measuring unit 12, the required number of L/C elements is defined for the matching of the two antennas 2. By means of the control cable 16, the master transmits corresponding measuring and/or adjusting commands to the slave for the matching of the respective antenna 2. In this case, the data exchange takes place in a synchronized manner. In particular, it is ensured by means of the master that the adjusting commands for the activation of the L/C elements are synchronized such that the two antennas 2 are excited in an antiphase and synchronous manner. The described matching or tuning operation is an iterative process, in the case of which, in each iteration cycle, the measured values as well as the adjusting commands are determined for controlling the matching operation for each antenna 2.

Because of the modular construction of the antenna system 1, the latter can be changed in a particularly simple manner in its arrangement. For example, the antenna system 1 can be reduced to a simple monopole antenna, in that one of the two antennas 2 is deactivated, for example, by a switching off by means of the control 14 or by means of a disconnection from the matching module 8.

According to the type and construction of the control unit 4, the respective matching module 8 may include a memory module 18 in addition or as an alternative. Preferably for various frequencies in the frequency range of from 2 to 30 MHz, for example, at a 5 MHz interval, in each case, the pertaining impedance values and the resulting required L/C elements (number and size) are filed in the memory module 18. Thus, independently of the actual measuring of the input impedance of the respective antenna 2, the matching of the antenna 2 is automatically permitted for a given frequency.

Figure 4:
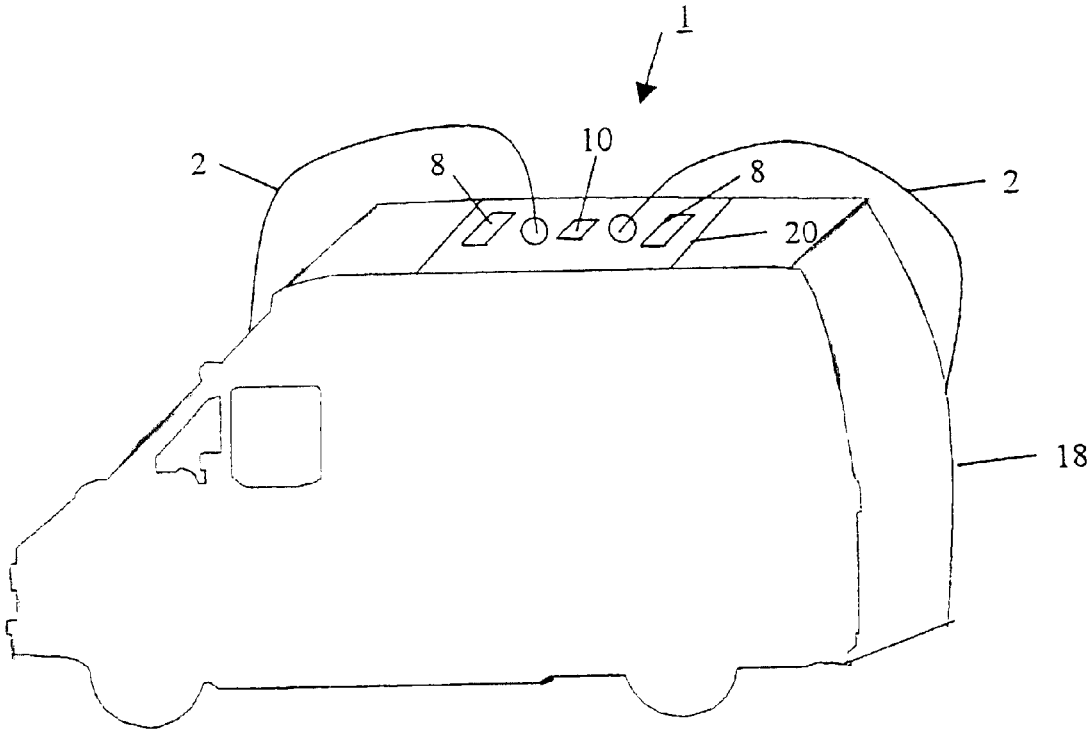
FIG. 4 is a view of a vehicle having an antenna system.

FIG. 4 shows a vehicle 18 with an antenna system 1 of the above-described type. In this case, the antenna system 1 is arranged on a carrier element 20, which is fastened on the roof of the vehicle 18. According to the type and the construction of the antenna system 1, the respective modules are individually or jointly, for example, surrounded by a housing, arranged on the carrier element 20. For example, as illustrated in FIG. 4, the respective matching module 8 for the pertaining antenna 2 is fastened on the carrier element 20. The two antennas 2 are arranged in the center with respect to the two matching modules 8 and are mutually connected by way of connection elements which are not shown. Furthermore, for the feeding of the antennas 2, the power divider module 10 is arranged at the base of the two antennas 2. No special demands are therefore made on the vehicle 18, so that the carrier element 20 with the antenna system 1 can be mounted on different vehicles 18 independently of the vehicle type. Because of its modular construction, the antenna system 1 can be arranged on the carrier element 20 in a simple manner. The individual elements of the antenna system 1 can be arbitrarily exchanged or replaced or supplemented. This can always take place independently of the vehicle 18. This ensures good flexibility and mobility of the antenna system 1.

The free ends of the two antennas 2 are arranged diametrically with respect to one another. For this purpose, the free ends are fastened such on the respective end of the vehicle 18 that they are held horizontally and diametrically with respect to one another. As a result of such a horizontal arrangement of the two antennas 2, the radiation characteristic is positively influenced. In particular, a radiation angle is achieved which is as vertical or steep as possible so that, during a use in the short-wave range, distances of from 0 to 300 km and farther are permitted as a function of the transmission power, the time of day and the radiation direction.

A rod antenna with a preferred length of approximately 4 m is used as the antenna 2, for example, for the mobile use. Rod antennas of a length of up to 7 m can also be used as other antennas 2 with a significant antenna gain and therefore a clear increase in available gain while the radiation characteristics are simultaneously as good as possible—a steep radiation characteristic of from 70° to 90° which is as good as possible—as well as a useful frequency range of from 2 to 30 MHz which is has broad as possible. As a result of the particularly simple and compact construction of the antenna system 1, the current Motor Vehicle Traffic Regulations are met with a vehicle of a length of 456 cm and a height of approximately 195 cm preferably being used as the vehicle 18.

What is claimed is:

1. An antenna system for electromagnetic waves, which functions as a dipole antenna in the short-wave range, said system comprising:

two antennas;

a control unit wherein the two antennas are connected with one another by way of the control unit and wherein the control unit comprise a power divider module and one matching module respectively for each of said two antenna;

a control cable for connecting the two matching modules with one another, wherein a matching operation of the antenna system occurs in an initialization process such that one of said two matching modules operates as a master module and another if said two operates as a slave module, wherein said module master transmits at least one of measuring and adjusting commands to the slave module by means of said control cable for the matching of a corresponding one of said two antennas.

2. The antenna system according to claim 1, wherein each of said two antennas is in each case provided as the antenna.

3. The antenna system according to claim 1, wherein the control unit and the two antennas are arranged on a carrier element.

4. The antenna system according to claim 3, wherein the carrier element is adopted to be on a vehicle.

5. The antenna system according to claim 1, wherein, the two antennas are connected with the control unit such that the two antennas can be excited by means of a phase shift of 180°.

6. The antenna system according to claim 1, wherein a matching module for a definable frequency comprises at least one inductor or capacitor element.

7. The antenna system according to claim 6, wherein the matching module comprises a measuring unit and a control.

8. The antenna system according to claim 6, wherein a transformer is provided as a power divider module.

9. The antenna system according to claim 1, on a vehicle wherein said system is used.

10. The antenna system according to claim 9, wherein at least one device is provided on the vehicle, which device holds the two antennas predominantly in a horizontal position and diametrical with respect to one another.

* * * * *